US011313119B2

(12) United States Patent
Rahbek

(10) Patent No.: US 11,313,119 B2
(45) Date of Patent: Apr. 26, 2022

(54) INTERIOR INSULATION SYSTEM WITH MOISTURE CONTROL

(71) Applicant: Rockwool International A/S, Hedehusene (DK)

(72) Inventor: Jens Eg Rahbek, Hedehusene (DK)

(73) Assignee: Rockwool International A/S, Hedehusene (DK)

( * ) Notice: Subject to any disclaimer, the term of this patent is extended or adjusted under 35 U.S.C. 154(b) by 0 days.

(21) Appl. No.: 17/260,594

(22) PCT Filed: Jul. 2, 2019

(86) PCT No.: PCT/EP2019/067656
§ 371 (c)(1),
(2) Date: Jan. 15, 2021

(87) PCT Pub. No.: WO2020/015998
PCT Pub. Date: Jan. 23, 2020

(65) Prior Publication Data

US 2021/0270033 A1 Sep. 2, 2021

(30) Foreign Application Priority Data

Jul. 18, 2018 (EP) ..... 18184166

(51) Int. Cl.
*E04B 1/76* (2006.01)
*E04B 1/66* (2006.01)
*E04B 1/78* (2006.01)

(52) U.S. Cl.
CPC ..... *E04B 1/7675* (2013.01); *E04B 1/665* (2013.01); *E04B 1/7645* (2013.01); *E04B 1/7658* (2013.01); *E04B 1/78* (2013.01)

(58) Field of Classification Search
CPC ..... E04B 1/7675; E04B 1/665; E04B 1/7645; E04B 1/7658; E04B 1/78
See application file for complete search history.

(56) References Cited

U.S. PATENT DOCUMENTS 4,841,707 A * 6/1989 Novoa ..... E04B 2/66 52/275
4,906,504 A * 3/1990 Skjold Petersen ..... E04B 1/762 428/85
5,230,763 A * 7/1993 Roth ..... H01Q 17/005 156/254
6,918,212 B1 7/2005 Anderson, Sr.
(Continued)

FOREIGN PATENT DOCUMENTS

WO 199707664 A1 3/1997
WO 2006014858 A1 2/2006

*Primary Examiner* — Rodney Mintz
(74) *Attorney, Agent, or Firm* — Dinsmore & Shohl LLP

(57) ABSTRACT

An interior insulation system with moisture control for an exterior building wall has a first insulation element adapted for abutting the interior surface of the external wall; a second insulation element abutting said first insulation element; a vapour barrier covering the interior surface of the second insulation element; and a support structure below the first and second insulation elements and supporting said first and second insulation elements The support structure has a gutter profile having a cavity with an upper opening and at least one ventilation opening, and a third insulation element is provided in at least a portion of said cavity.

19 Claims, 4 Drawing Sheets

(56) References Cited

U.S. PATENT DOCUMENTS 7,313,891 B2 * 1/2008 Showers ..... E04B 1/7069 52/169.11
9,441,364 B2 * 9/2016 Bertoldini ..... E04B 2/88
9,546,480 B2 * 1/2017 Jakobsen ..... E04B 7/022
9,587,399 B2 * 3/2017 Jakobsen ..... E04B 1/18
9,909,305 B2 * 3/2018 Lee ..... E04B 1/7675
10,851,543 B2 * 12/2020 Grisolia ..... E02D 27/02
11,035,119 B2 * 6/2021 Sorensen ..... E04B 2/7412
11,193,271 B2 * 12/2021 Simonic ..... E04B 2/7457
2002/0164447 A1 * 11/2002 Asgian ..... E04D 12/002 428/40.1
2006/0236653 A1 10/2006 Showers
2007/0163191 A1 7/2007 Berry
2011/0130062 A1 * 6/2011 Squires ..... C08J 7/048 442/327
2013/0078422 A1 * 3/2013 Tinianov ..... B32B 5/022 428/138
2015/0275512 A1 * 10/2015 Bertoldini ..... E04B 2/90 52/236.6
2015/0300003 A1 * 10/2015 Jakobsen ..... E04B 1/762 52/506.05
2016/0115690 A1 * 4/2016 Jakobsen ..... E04B 1/18 52/404.4
2016/0130801 A1 * 5/2016 Jakobsen ..... E04D 13/1681 52/90.1
2016/0194877 A1 * 7/2016 Nowak ..... E04B 1/6145 52/847
2016/0376787 A1 * 12/2016 Grisolia ..... E04B 2/707 52/236.3
2017/0030072 A1 * 2/2017 Corson ..... E04B 7/04
2017/0362823 A1 * 12/2017 Lee ..... E04C 3/32
2019/0154295 A1 * 5/2019 Duffy ..... F16L 59/143
2020/0199869 A1 * 6/2020 Simonic ..... E04B 2/7411
2020/0208399 A1 * 7/2020 Keller ..... E04B 2/02
2021/0040736 A1 * 2/2021 Sorensen ..... E04B 2/7457
2021/0180309 A1 * 6/2021 Charest ..... E04B 1/14

* cited by examiner

INTERIOR INSULATION SYSTEM WITH MOISTURE CONTROL

CROSS-REFERENCE TO RELATED APPLICATIONS

This application is the U.S. national stage of PCT/EP2019/067656 filed Jul. 2, 2019, which claims priority of European patent application 18184166.9 filed Jul. 18, 2018, both of which are hereby incorporated by reference in their entirety.

FIELD OF THE INVENTION

The present invention relates to an interior insulation system with moisture control for an exterior building wall, said system comprising a first mineral wool insulation element adapted for abutting the interior surface of the external wall; a second mineral wool insulation element abutting said first insulation element; a vapour barrier covering the interior surface of the second insulation element; a support structure below the first and second insulation elements and supporting said first and second insulation elements.

BACKGROUND OF THE INVENTION

Such interior insulation systems are also known as internal wall insulation, inner or insulated dry lining and are fitted to the inner surface of an external building wall and are mainly designed to thermally insulate, respectively to avoid heat loss.

From WO2006/014858 such an exterior wall insulating system is known.

In some types of buildings, it is required or advantageous that the exterior walls of the building are insulated to improve the interior climate in the building and to save energy. In particular in relation to old buildings, it is often not possible to provide a new façade with insulation on the exterior side of the building. Instead an interior insulation system is provided. However, having the insulation on the inside (the warm side) of the exterior wall can lead to water condensation inside the insulation layer, which in turn means that the insulation system must be able to absorb such moisture and prevent the generated moisture from damaging the interior building structures, such as wooden floors or the like.

The moisture may occur from different sources. Water may penetrate through small cracks in the exterior wall, such as a masonry wall. Water may diffuse through an imperfect vapour barrier and the internally fitted insulation and condensate on the inside of the cold wall. To address this, in WO2006/014858 there is incorporated a wicking media in the insulation product to transport the condensate away from the interface between the insulating product and the exterior wall and down to the lower part of the insulation system. The condensate will be removed to a more interior location where it can then evaporate into the interior room of the building, due to the higher temperature in the interior room.

The downside of this solution is that it does not provide a water buffer meaning that the water has to evaporate as fast back to the room as it come in. If this is not possible it might lead to that the water will enter other cavities in the construction and cause damages such as growth of mould and fungus in the construction, which is particularly harmful for the wooden structures.

Moreover, the lower part of the insulation system is not insulated and will act as a thermal bridge. If the temperature in this lower part of the insulation system is not sufficiently high, there is a risk that the water rather than evaporate will be soaking the floor or lower construction parts and thereby increasing the risk of causing damage to the building construction.

SUMMARY OF THE INVENTION

Accordingly, it is an object by the present invention to provide an interior insulation system for a building where condensate water can be transported or guided and retained in a reservoir without the risk of soaking the floor or lower construction parts.

This object is achieved by an interior insulation system of the initially mentioned kind, wherein the support structure comprises a gutter profile having a cavity with an upper opening and at least one ventilation opening, and wherein a third mineral wool insulation element is provided in at least a portion of said cavity.

According to the invention it is found advantageous that by providing a gutter profile a tray structure is provided which can accommodate any surplus liquid condensate, since the water vapour absorbed in the first mineral wool insulation can be transported via the upper opening and into the gutter profile. Hereby, any condensed water is stored and prevented from entering into the construction parts of the building. The water vapour or condensed water can also be confined in the third mineral wool insulation element inside the profile and evaporate through the ventilation opening(s) into the interior room of the building.

Thus, by a system according to the invention, it is advantageously achieved that condensed water can be stored in the gutter profile and the insulation material therein so that a delayed release back into the room of the water in evaporated form can be achieved.

By the invention, the function of the "moisture control" is able to handle condensed water and provides a water buffer in the gutter profile. The third mineral wool element in that respect confines the water inside the gutter profile so that the water in the form of vapour can evaporate later on from the cavity in the gutter profile.

Moreover, by providing a third mineral wool insulation element in the cavity of the gutter profile, the thermal conductivity of the lower profile structure and any unwanted thermal bridging is reduced.

Preferably, an inner wall cover, such as a gypsum board, is provided on the vapour barrier on the interior surface of the second insulation element. Hereby, vapour is prevented from diffusing from the interior of the building into the insulation.

In a preferred embodiment, at least the first and the third mineral wool insulation elements are made of hydrophilic mineral wool fibrous material. Hereby, the water transport capabilities of the mineral wool insulation material are increased. To further increase the water absorption of the elements, at least one mineral wool element may comprise a wetting agent.

In an advantageous embodiment, the hydrophilic mineral wool insulation elements comprise an anti-microbial substance, such as Benzalkonium chloride. Hereby, the mineral wool is provided with an anti-fungi treatment so that any build-up of mould on the cold inner surface of the exterior wall is prevented.

In preferred embodiments, the density of the first and/or second mineral wool insulation elements is 20-120 kg/m$^3$, preferably 30-100 kg/m$^3$, more preferably 40-80 kg/m$^3$. They provide for the thermal performance of the system.

Advantageously, a third mineral wool insulation element has a density, which is higher than the density of the first and second mineral wool insulation elements, and said density of the third mineral wool insulation element is from 150-250 kg/m$^3$, preferably approx. 200 kg/m$^3$. Hereby, the third mineral wool element can carry the first and second mineral wool elements as well as the gypsum board without being compressed, respectively ensuring that the gutter profile doesn't deflect under the load of the construction.

The gutter profile preferably comprises an upright first wall portion adapted for abutting the inner side of the exterior wall, a substantially horizontal base portion (perpendicular to said first wall portion), a second innermost upright wall portion for receiving a mounting of a floor panel or the like, and one or more insulation support portions, and wherein the cavity is defined by said first and second wall portions, said base portion and one or more insulation support portions. Hereby, a light-weight profile can be provided, which is simple and inexpensive to manufacture. Preferably, in the gutter profile, the insulation support portions comprise an upwards facing first support surface for the second insulation element and an upwards facing second support surface for accommodating the inner wall cover.

In the currently preferred embodiment, the portion of the cavity of the gutter profile underneath the second support surface is void. Furthermore, said second support surface is provided with a plurality of ventilation openings in at least a portion of said support surface. The second support surface is preferably extending a width larger than the width of the inner wall cover leaving a gap between said inner wall cover and a floor panel above the second support surface, and wherein the ventilation openings are provided at least in said gap portion of the second surface.

To facilitate easy installation, a U-shaped profile is preferably mounted on the upwards facing first support surface for receiving the second insulation element.

In order to achieve a compact insulation system, it is advantageous that the upper opening of the gutter profile is arranged so that the first insulation element is supported directly by the third insulation element.

Preferably the gutter profile is a metal profile, preferably aluminium, and in particular, the gutter profile is preferably made of a sheet metal, which is bent into shape. Hereby, the profile can be produced from a thin metal sheet, such as 1 mm thick aluminium profile, which ensures a high thermal conductivity through the profile that will heat up the deck construction and reduce the risk of mould, which is advantageous when the deck construction is made of wood. If the deck is made of inorganic material, such as concrete, the gutter profile can advantageously be made of plastic.

In the insulation system according to the invention, the support structure preferably comprises both a lowermost support member and an uppermost support member for holding the insulation elements in place, wherein the lowermost member is the gutter profile. Hereby, the insulation system according to the invention may be used in accordance with the basic principle of well-known structures for partition walls, comprising horizontal base and ceiling U-profiles and vertical C-profiles. Said base or bottom U-profile forming the uppermost support member of the support structure.

BRIEF DESCRIPTION OF THE DRAWINGS

In the following the invention is described in more detail with reference to the accompanying drawings in which.

DETAILED DESCRIPTION OF THE PREFERRED EMBODIMENTS

Figure 1:
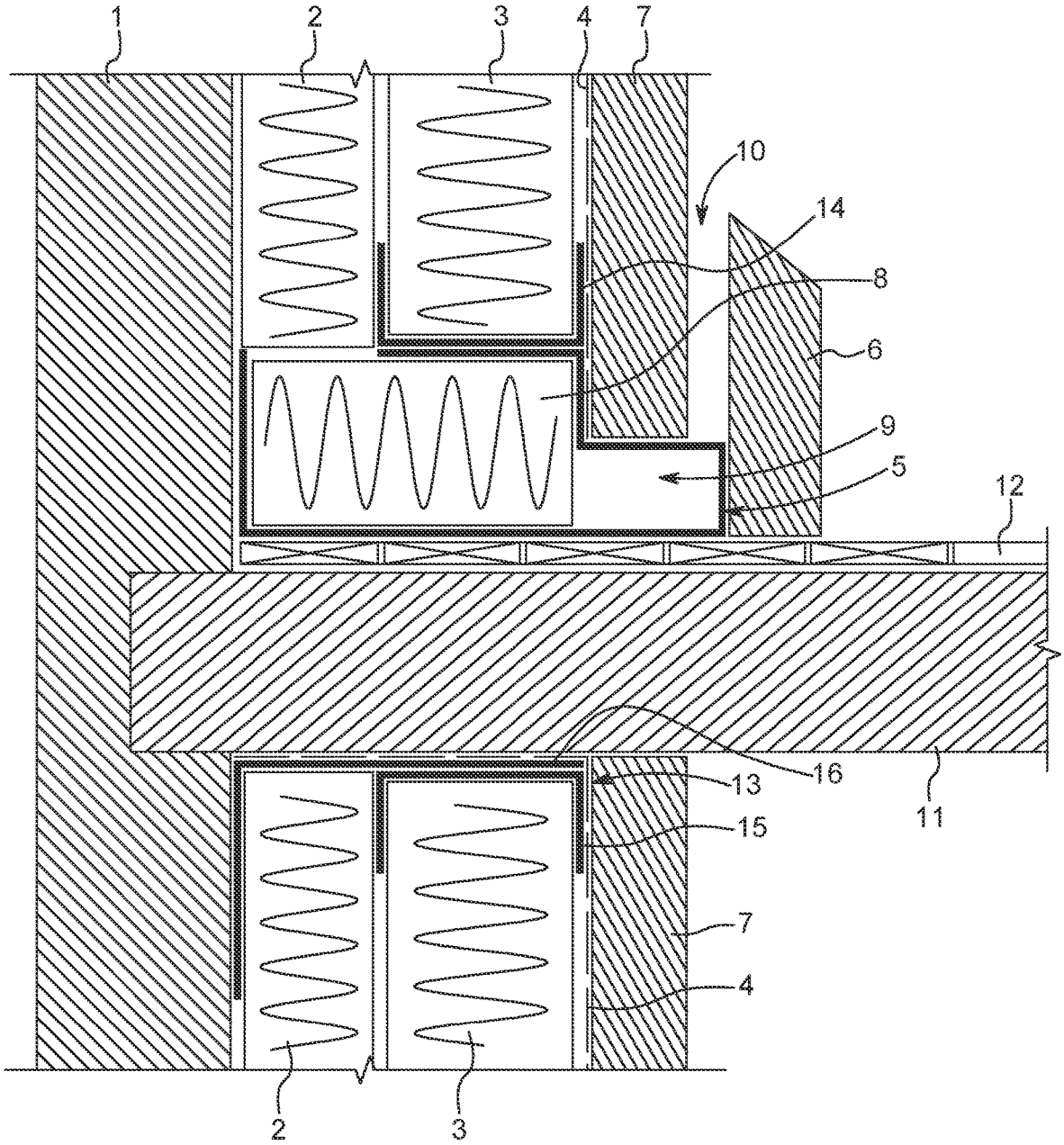
FIG. 1 is a schematic cross-sectional side view of an interior insulation system with moisture control according to an embodiment of the invention.

In FIG. 1 an embodiment of the interior insulation system according to the invention is shown. On the inside of an exterior building wall 1, the insulation system is installed on the floor 12 of a wood deck 11. In FIG. 1 the lowermost section of the insulation system installed on the wood deck is shown, and also the top section of an insulation system installed underneath the wood deck 11 and at a lower story is shown.

As shown in FIG. 1, a gutter profile 5 is provided on the top of the floor panels abutting the inner surface of the outer wall 1. On top of the gutter profile 5, a first mineral wool insulation element 2 is provided covering the inner surface of the exterior wall 1. A second mineral wool insulation element 3 is provided next to the first insulation element 2. The second insulation element 3 is accommodated in a U-shaped bottom profile 14 provided on top of the gutter profile 5. On the inside of the second insulation element 3 a vapour barrier 4 is provided, which is liquid and gas impermeable and extends downward covering not only the inner surface of the second insulation element 3 but also a portion of the gutter profile 5 as shown in FIG. 1. On the interior facing side of the insulation and inside the vapour barrier 4 a gypsum plaster board 7 is provided as inner wall cover. On the innermost portion of the gutter profile 5 a skirting board 6 may be mounted as shown in FIG. 1. Between the skirting board 6 and the inner wall cover 7 a small gap 10 is provided so that moisture accumulating in the cavity 58 of the gutter profile 5 may evaporate through ventilation openings 57 in the gutter profile 5 (see FIG. 3) and via the gap 10 into the interior room of the building.

In the bottom of FIG. 1, it is shown the top mounting system 13 for holding the top portion of the insulation system according to an embodiment the invention to the lower side of the deck 11. An L-shaped profile 16 is provided in the corner between the inner surface of the exterior wall 1 and the wood deck 11. An inverted U-shaped profile 15 is provided for holding the second insulation element 3. Hereby, a slot for accommodating the top edge portion of the first insulation element 2 is provided between the vertical portion of the L-profile 16 and the exterior facing side of the inverted U-shaped profile 15. Similarly, in the inverted U-shaped profile 15 there is also a slot for accommodating the top of the second insulation element 3.

Figure 2:
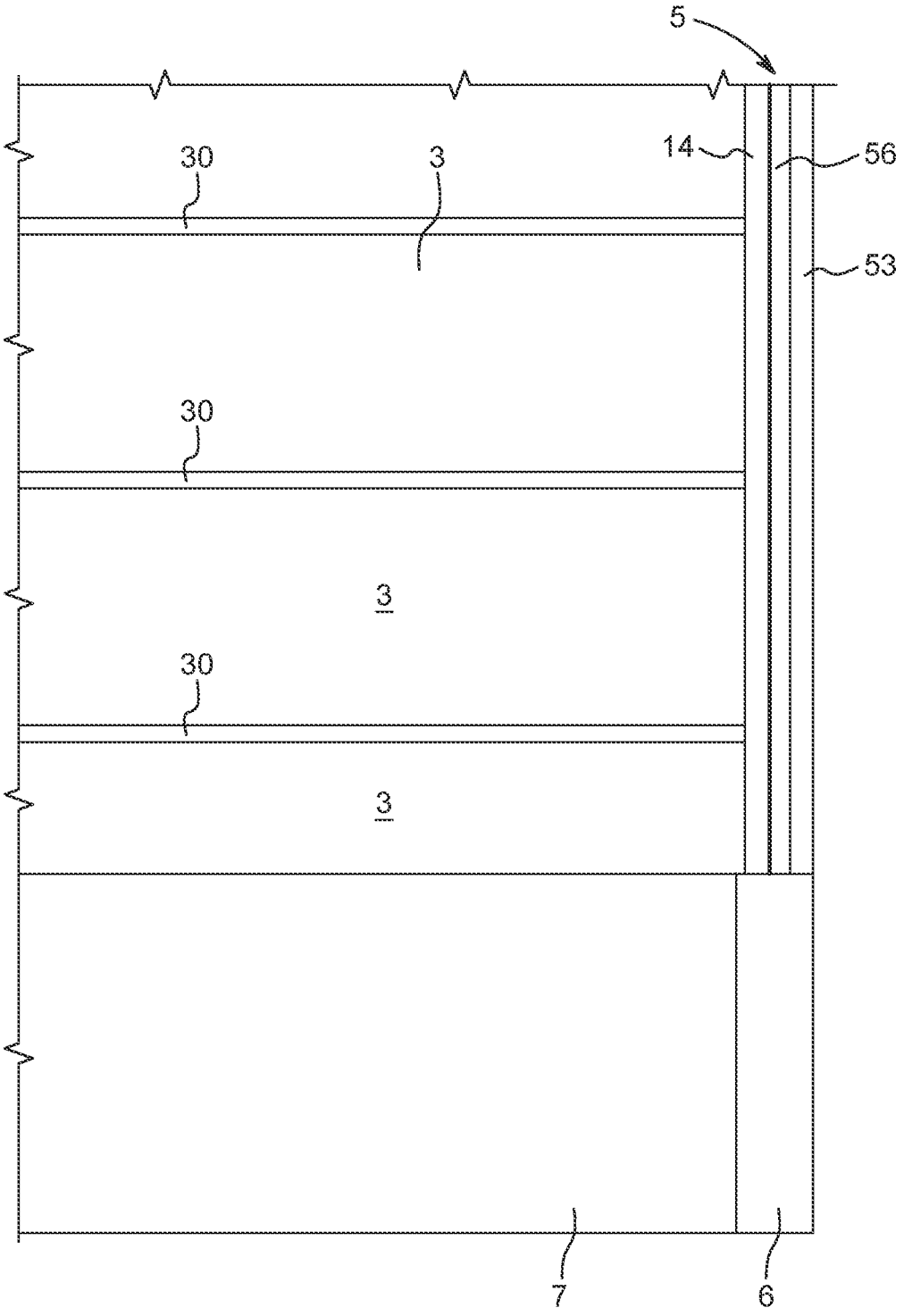
FIG. 2 is a front view of same, where the insulation elements are partly covered by an inner wall cover.

In FIG. 2 the interior insulation system is shown seen from the inside partly installed. To the left of the figure, the inner wall cover 7 and the skirting board 6 are also mounted, whereas in the centre and the right side of the figure, the gutter profile 5 and the U-shaped profile 14 on top of the gutter profile 5 are visible. As also shown, the insulation system will comprise vertical frame profiles 30, like traditional C-profiles extending between the top profile system 13 and the bottom U-shaped profile 14 of the insulation system for holding the insulation elements 3 in place and providing the structural strength of the system.

Figure 3:
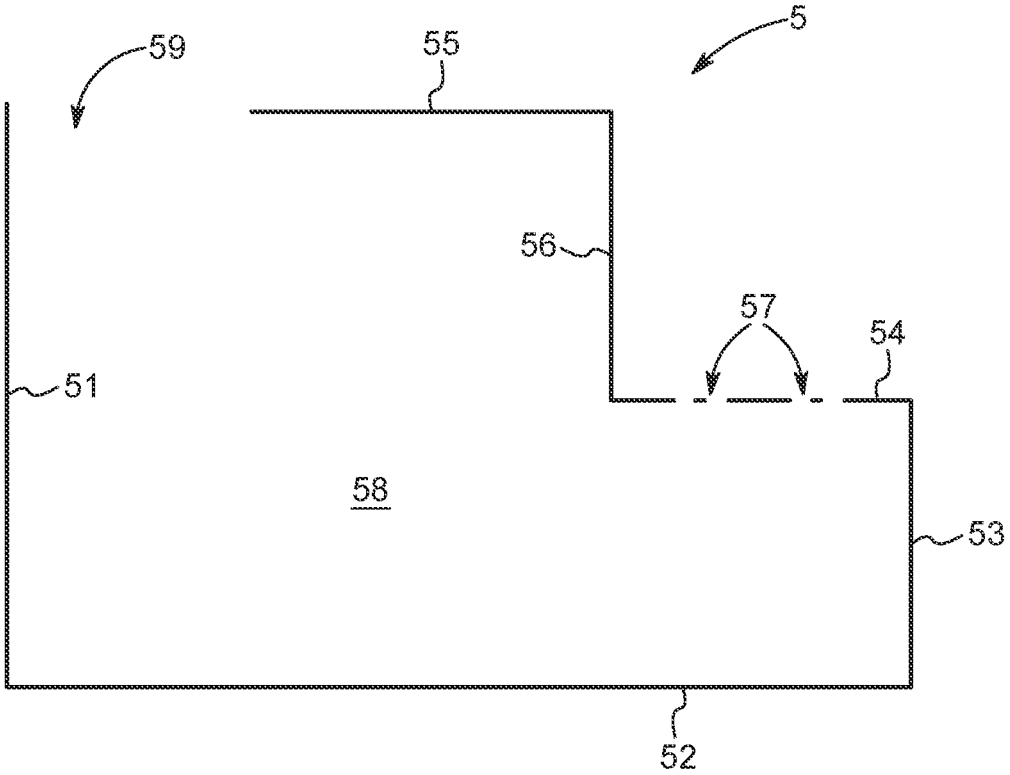
FIG. 3 is a schematic cross-sectional view of the gutter profile according to the invention.

With reference to FIG. 3, the gutter profile 5 is shown with its various sections. The gutter profile 5 is preferably made from a metal sheet which is bent into the desired shape. In an alternative embodiment, the gutter profile is made of plastic material.

In the shown embodiment, the profile 5 has an upright first wall portion 51 adapted for abutting the inner side of the exterior wall 1, a substantially horizontal base portion 52 (perpendicular to said first wall portion), a second innermost upright wall portion 53 for receiving a mounting of a skirting board 6 or the like (see FIG. 2), a horizontal support portion 54 succeeded by an upwards facing portion 56 and an insulation support portion 55. The cavity 58 of the gutter profile 5 is defined by said first and second wall portions 51, 53, said base portion 52 and the insulation support portion 55 and the step portions 54 and 56. An upper opening 59 is hereby also provided such that the first insulation element 2 can rest on the third insulation element 8 provided inside the cavity 58 (see FIG. 1).

At least the first and third mineral wool insulation elements 2, 8 are advantageously adapted to absorb water and hence may be denoted as hydrophilic mineral wool fibrous elements. To achieve this effect, it is found advantageous that the mineral wool elements are made with a wetting agent to provide the mineral wool with increased hydrophilic properties. Other options however are available to achieve hydrophilicity as will appear from the below.

Mineral Wool

The mineral wool for the mineral wool fibrous elements are made of Man-made vitreous fibres (MMVF) which can be glass fibres, ceramic fibres, basalt fibres, slag wool, stone wool and others, but are usually stone wool fibres, bounded with a binder. Stone wool generally has a content of iron oxide at least 3% by weight and content of alkali earth metals such as calcium oxide and magnesium oxide from 10 to 40% by weight along with the other usual oxide constituents of MMVF. These are silica; alumina; alkali metals such as sodium oxide and potassium oxide which are usually present in low amounts; and can also include titania and other minor oxides. Fibre diameter is often in the range of 2 to 10 μm, preferably 3 to 5 μm. The MMVF material is in the form of a coherent mass. That is, the MMVF material is generally a coherent matrix of MMVF, which has been produced as such and formed into mineral wool elements for the interior insulation system according to the present invention.

Hydrophilicity

Normal the MMVF material for mineral wool insulation contains oil for making the products hydrophobic and prevents them from absorbing moisture. The MMVF material for the first and third mineral wool fibrous elements of the interior insulation system is however, manufactured without adding of oil to make the elements less hydrophobic, and may even be hydrophilic so that it attracts water. The MMVF material for the elements can be hydrophilic due to the binder system used, the binder itself may be hydrophilic and/or a wetting agent is used.

The hydrophilicity of a sample of MMVF can be measured by determining the sinking time of a sample. A sample of MMVF material having dimensions of 100×100×65 mm is required for determining the sinking time. A container with a minimum size of 200×200×200 mm is filled with water. The sinking time is the time from when the sample first contacts the water surface to the time when the test specimen is completely submerged. The sample is placed in contact with the water in such a way that a cross-section of 100×100 mm first touches the water. The sample will then need to sink a distance of just over 65 mm in order to be completely submerged. The faster the sample sinks, the more hydrophilic the sample is. The MMVF material is considered hydrophilic if the sinking time is less than 120 seconds.

Preferably, the sinking time is less than 60 seconds. In practice, the MMVF material may have a sinking time of a few seconds, such as less than 10 seconds.

When the binder is hydrophobic, a wetting agent is additionally included in the MMVF material in order to ensure that the material is hydrophilic. A wetting agent will increase the amount of water that the MMVF material can absorb. The use of a wetting agent in combination with a hydrophobic binder results in a hydrophilic MMVF material.

The wetting agent used may be any of the wetting agents known for use in MMVF material that are used for growth substrates. For instance, it may be a non-ionic wetting agent such as Triton X-100 or Rewopal. Other wetting agents may be used, for instance anionic wetting agents such as linear alkyl benzene sulphonate or sodium lauryl ether sulphate (also called SLES). An example of an anionic SLES is Disponil FES27A supplied by BASF.

In a preferred embodiment, the wetting agent is a Benzalkonium chloride, which is commercially available under the trademark name Rodalon® by Brenntag Nordic A/S. Said wetting agent is particularly beneficial as it also acts as an anti-microbial substance which will be apparent from the description further down.

The binder of the MMVF material can be hydrophilic. The hydrophilic binder does not require the use of a wetting agent. A wetting agent can nevertheless be used to increase the hydrophilicity of a hydrophilic binder in a similar manner to its action in combination with a hydrophobic binder. This means that the MMVF material will absorb water faster than if the wetting agent is not present. Any hydrophilic binder known per se can be used.

Binder

The binder may be any binders known for use as binders for coherent MMVF products. The binder may be an aldehyde based resin such as phenol formaldehyde resin (PF), phenol urea formaldehyde resin (PUF), urea formaldehyde resin (UF), melamine formaldehyde resin (MF), melamine urea formaldehyde resin (MUF), melamine phenol formaldehyde resin (MPF), and melamine urea phenol formaldehyde resin (MUPF). This type of binder can be economically produced for use as a binder in many applications including mineral wool elements of the type used in the present invention.

The binder may be a formaldehyde-free aqueous binder composition comprising: a binder component (A) obtainable by reacting at least one alkanolamine with at least one carboxylic anhydride and, optionally, treating the reaction product with a base; and a binder component (B) which comprises at least one carbohydrate, as disclosed in WO2004/007615. Binders of this type are hydrophilic.

Further formaldehyde-free binder compositions such as those comprising:

a) a sugar component, and b) a reaction product of a polycarboxylic acid component and an alkanolamine component, wherein the binder composition prior to curing contains at least 42% by weight of the sugar component based on the total weight (Dry matter) of the binder components may be used in the present invention, preferably in combination with a wetting agent.

The binder may be a furan binder, as disclosed in WO97/07664, which lends its hydrophilic properties to the material. The use of furan resin allows for not adding a wetting agent. Binders of this type may be used in the hydrophilic mineral wool elements in the present invention.

The mineral wool elements are made by melting the raw materials in large cupola furnaces at a temperature of about 1500° C. The melt is directed onto a series of fast rotating wheels spinning (if stone wool) and formed into rock fibres with an average diameter of about 2 to 10 microns. A binding agent is added and, for hydrophilic products, an additional wetting agent can be introduced (see above). The wool is then cured in special curing ovens.

The mineral wool insulation elements may further be provided with an anti-microbial substance, such as Benzalkonium chloride. Benzalkonium chloride, which is commercially available under the trademark name Rodalon® by Brenntag Nordic A/S, is advantageous in the context of the present invention due to its anti-fungi properties and thereby preventing any occurrence of mould on the wall on which the insulation system is mounted.

Figure 4:
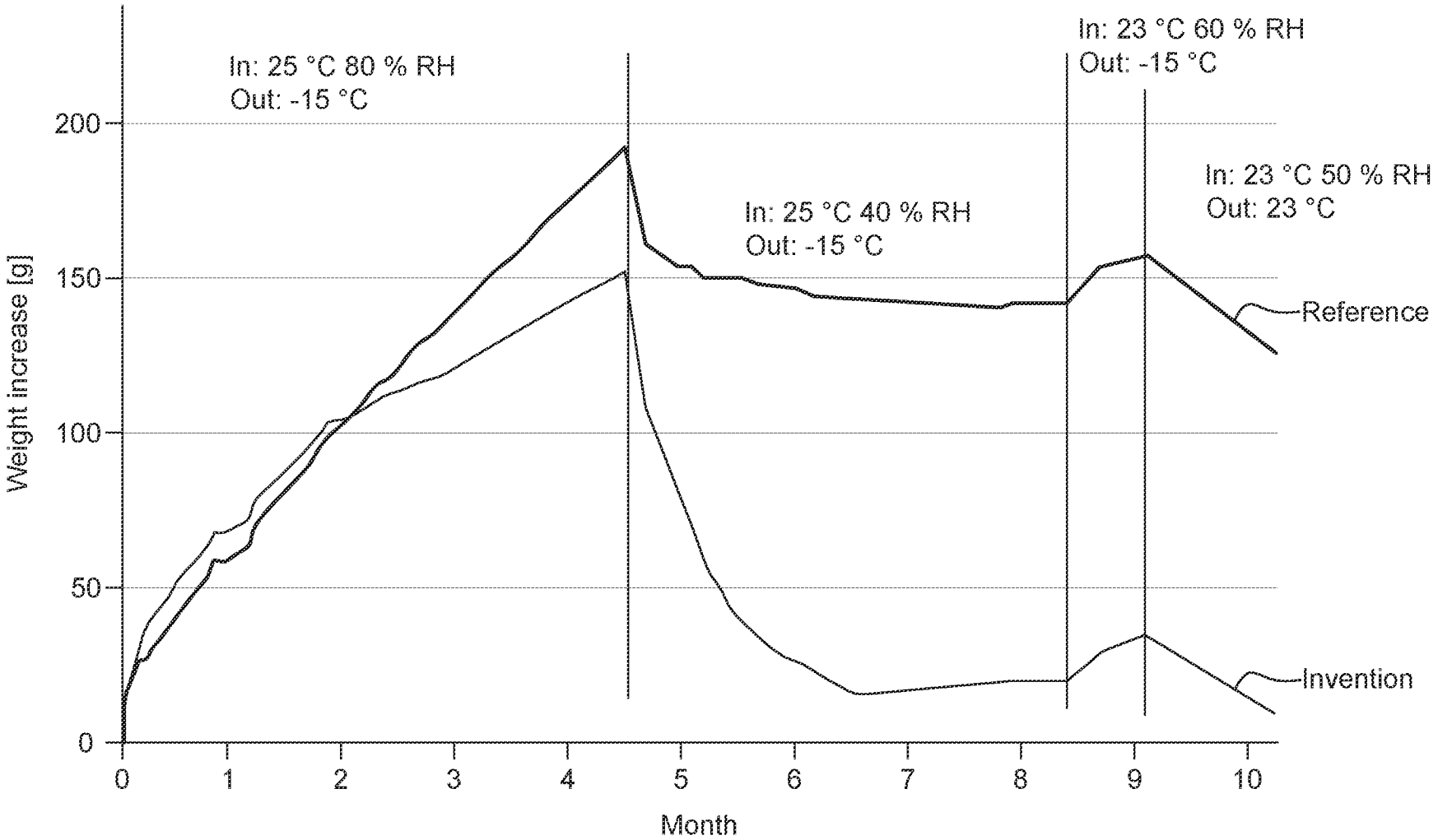
FIG. 4 is a diagram showing the performance of an interior insulation system according to the invention compared to a traditional interior insulation system.

In FIG. 4, the graph shows the water uptake and release over time for two types of interior insulation. The measurements are done in laboratory with controlled climatic conditions.

By the term or function "moisture control" used in this disclosure is meant the control of the water uptake and release over time for an interior insulation, which function is guaranteed using a gutter profile comprising said third mineral wool insulation element according to the present invention.

The upper curve (blue) is the reference and represents a traditional interior insulation system. Here an existing wall is insulated with 100 mm hydrophobic mineral wool with a density of around 50 kg/m$^3$ followed by a 0.2 mm plastic vapour barrier and a gypsum board. The gypsum board is mounted on 38×56 mm timber battens. The vapour barrier is sealed around the perimeter in order to make it as tight as possible.

The second curve (red) represents the solution according to the present invention with 50 mm hydrophilic mineral wool with a density of around 40 kg/m$^3$ followed by 50 mm hydrophobic mineral wool with a density of around 50 kg/m$^3$ followed by a 0.2 mm plastic vapour barrier of the same type and with identical properties than the one tested with the traditional system, and a gypsum board. The gypsum board is mounted on 45×40 mm thin metal C-profiles. The vapour barrier is sealed to the ceiling and the walls and to the gutter profile at floor in order to make it as tight as possible.

The size of each of the tested wall elements is 40×60 cm; the material of the existing wall is chosen of 100 mm light concrete.

In the measurements the temperature is controlled at the outside of the wall and the temperature and humidity is controlled on the inside of the wall.

The weight increase was measured on a digital weight once a week.

In the first 4 month hot, very humid inside conditions (25° C. and 80% relative humidity (RH)) and cold outside conditions (−15° C.) was simulated. Here both constructions absorbed moisture.

In the next 4 month hot moderate humid inside conditions (25° C. and 40% RH) and cold outside conditions (−15° C.) was simulated. Here the reference solution had a moderate evaporation while the solution according to the present invention had a much faster evaporation.

In the next month hot relative humid inside conditions (23° C. and 60% RH) and cold outside conditions (−15° C.) was simulated. Here both constructions absorbed a little moisture.

In the next month hot relative low humid inside conditions (23° C. and 50% RH) and warm outside conditions (23° C.) was simulated. Here both constructions evaporated a little moisture.

After 10 month the amount of water in the solution according to the present invention was more than 10 times lower than in the reference solution. This reduces the risk of growth mould and fungus very much.

When doing interior insulation measures in a building with a wooden deck there is a risk that because the wall become colder it can lead to mould in the wood construction. In a preferred embodiment of the present invention, this risk is minimized by using heat conductive metal profiles, such as aluminium profiles, that heat up the area where the wood deck touches the wall, respectively where it is supported in the external wall structure.

To quantify this effect simulations of the temperatures have been performed on an exterior building wall with a wood deck construction as shown in FIG. 1. The 2D calculation tool Therm 7.0 developed by Berkeley National Laboratory have been used.

The temperature in the middle of the wood deck was calculated with and without the metal profiles. The inside temperature was set to 20° C. and the outside temperature was set to −12° C.

Without the metal profiles the wood temperature was calculated at 1.9° C.; with the metal profiles the wood temperature was calculated to 5.5° C.; meaning a raise of 3.6° C. This temperature difference of 3.6° C. substantially reduces the risk of mould.

Above the invention is described with reference to some preferred embodiment. However, it is realised by the invention that other embodiments or variants of the above described examples of an interior insulation system according to the invention may be provided without departing from the accompanying claims.

The invention claimed is:

1. An interior insulation system with moisture control for an exterior building wall, said system comprising:

a first, discrete mineral wool insulation element configured to abut an interior surface of the external wall;

a second, discrete mineral wool insulation element abutting said first insulation element;

a vapour barrier covering an interior surface of the second insulation element; and a support structure positioned below the first and second insulation elements and supporting said first and second insulation elements;

wherein the support structure comprises a gutter profile having a cavity with an upper opening and at least one ventilation opening, and wherein a third, discrete mineral wool insulation element is positioned in at least a portion of said cavity.

2. The interior insulation system according to claim 1, wherein the upper opening of the gutter profile is arranged so that the first insulation element is supported directly by the third insulation element.

3. The interior insulation system according to claim 1, wherein the gutter profile is made of a sheet metal, which is bent into shape.

4. The interior insulation system according to claim 1, wherein the gutter profile is made of plastic.

5. The interior insulation system according to claim 1, wherein the gutter profile is a metal profile.

6. The interior insulation system according to claim 5, wherein the metal profile is aluminum.

7. The interior insulation system according to claim 1, wherein an inner wall cover is provided on the vapour barrier on the interior surface of the second insulation element.

8. The interior insulation system according to claim 7, wherein the inner wall cover is a gypsum board.

9. The interior insulation system according to claim 1, wherein the third mineral wool insulation element has a density, which is higher than a density of the first and second mineral wool insulation elements, and said density of the third mineral wool insulation element is from 150 to 250 $kg/m^3$.

10. The interior insulation system according to claim 9, wherein said density of the third mineral wool insulation element is approximately 200 $kg/m^3$.

11. The interior insulation system according to claim 1, wherein at least the first and the third insulation elements are made of hydrophilic mineral wool fibrous material.

12. The interior insulation system according to claim 11, wherein the hydrophilic mineral wool insulation elements comprise a wetting agent.

13. The interior insulation system according to claim 11, wherein the hydrophilic mineral wool insulation elements comprise an anti-microbial substance.

14. The interior insulation system according to claim 13, wherein the anti-microbial substance is Benzalkonium chloride.

15. The interior insulation system according to claim 1, wherein the gutter profile comprises an upright first wall portion adapted for abutting the inner side of the exterior wall, a substantially horizontal base portion perpendicular to said first wall portion, a second innermost upright wall portion for receiving a mounting of a skirting board, and one or more insulation support portions, and wherein the cavity is defined by said first and second wall portions, said base portion and one or more insulation support portions.

16. The interior insulation system according to claim 15, wherein in the gutter profile, the insulation support portions comprise an upwards facing first support surface for the second insulation element and an upwards facing second support surface for accommodating an inner wall cover.

17. The interior insulation system according to claim 16, wherein a U-shaped profile is mounted on the upwards facing first support surface for receiving the second insulation element.

18. The interior insulation system according to claim 16, wherein said second support surface is provided with a plurality of ventilation openings in at least a portion of said support surface.

19. The interior insulation system according to claim 18, wherein said second support surface is extending a width larger than a width of an inner wall cover leaving a gap between said inner wall cover and a floor panel above the second support surface, and wherein the ventilation openings are provided at least in said gap portion of the second surface.

* * * * *